US006155708A

United States Patent [19]

Lindley

[11] Patent Number: 6,155,708

[45] Date of Patent: Dec. 5, 2000

[54] CONCRETE VIBRATOR WITH OFFSET ROTOR

[76] Inventor: Thomas R. Lindley, 7845 Wice Church Rd., Boaz, Ky. 42027

[21] Appl. No.: 09/233,801

[22] Filed: Jan. 19, 1999

[51] Int. Cl.[7] ..... B01F 11/00

[52] U.S. Cl. ..... 366/123

[58] Field of Search ..... 366/120, 123, 366/128

[56] References Cited

U.S. PATENT DOCUMENTS

| | | |
|---|---|---|
| 1,988,316 | 1/1935 | Jackson . |
| 2,061,943 | 11/1936 | Jorgensen . |
| 2,073,393 | 3/1937 | Mall . |
| 2,148,765 | 2/1939 | Mall . |
| 2,269,938 | 11/1942 | Jackson . |
| 2,278,839 | 4/1942 | Douglas . |
| 2,295,283 | 9/1942 | Mall . |
| 2,454,620 | 11/1948 | Wilde . |
| 2,479,799 | 8/1949 | Wilde . |
| 2,492,431 | 12/1949 | Kroeckel . |
| 2,771,279 | 11/1956 | Dearden . |
| 2,852,946 | 9/1958 | Petrin . |
| 3,042,386 | 7/1962 | Wyzenbeek . |
| 3,180,625 | 4/1965 | Wyzenbeek . |
| 3,188,054 | 6/1965 | Mason, Jr. . |
| 3,260,509 | 7/1966 | Rudy et al. . |
| 4,057,222 | 11/1977 | Lyle . |
| 4,199,264 | 4/1980 | Uebel . |
| 4,428,678 | 1/1984 | Lyle . |
| 4,460,346 | 7/1984 | Behnke . |
| 4,526,049 | 7/1985 | Pottgens . |
| 5,108,189 | 4/1992 | Oswald . |
| 5,564,824 | 10/1996 | Chaplin et al. . |
| 5,716,131 | 2/1998 | Breeding ..... 366/120 |
| 5,829,874 | 11/1998 | Breeding . |

FOREIGN PATENT DOCUMENTS

| | | | |
|---|---|---|---|
| 2060538 | 6/1992 | Germany | 366/123 |

*Primary Examiner*—Charles E Cooley
*Attorney, Agent, or Firm*—King and Schickli, PLLC

[57] ABSTRACT

A lightweight, portable concrete vibrator is provided. A vibrator head includes a hollow casing with an eccentric rotor having a curved segment along one side extending in an arc of 120° so as to position the rotor centroid at the most favorable position to induce maximum vibration for aggregate distribution and filling of voids or air pockets in wet concrete. An inverted, V-shaped stiffening segment is formed on the opposite side of the rotor. The ratio of the centroid offset from the rotation axis to the diameter is in the range of 1:3.5–1:3.75. A tubular support assembly forms the handle for the motor. Preferably, the motor is a small, two cycle engine operating in the range of 5,000 to 7,000 rpms. A bearing sleeve may be provided adjacent the distal end of the vibrator head in order to accommodate any incidental lateral flexing of the rotor in the casing.

14 Claims, 3 Drawing Sheets

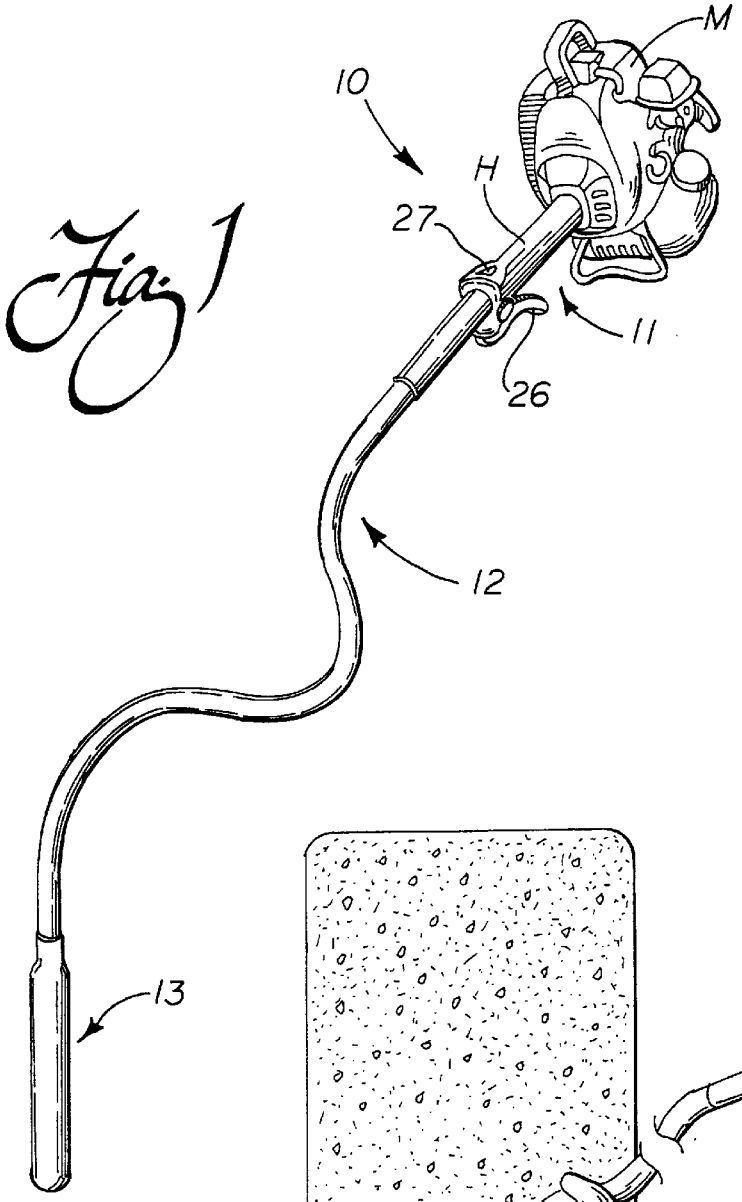
Fig. 1
Fig. 2
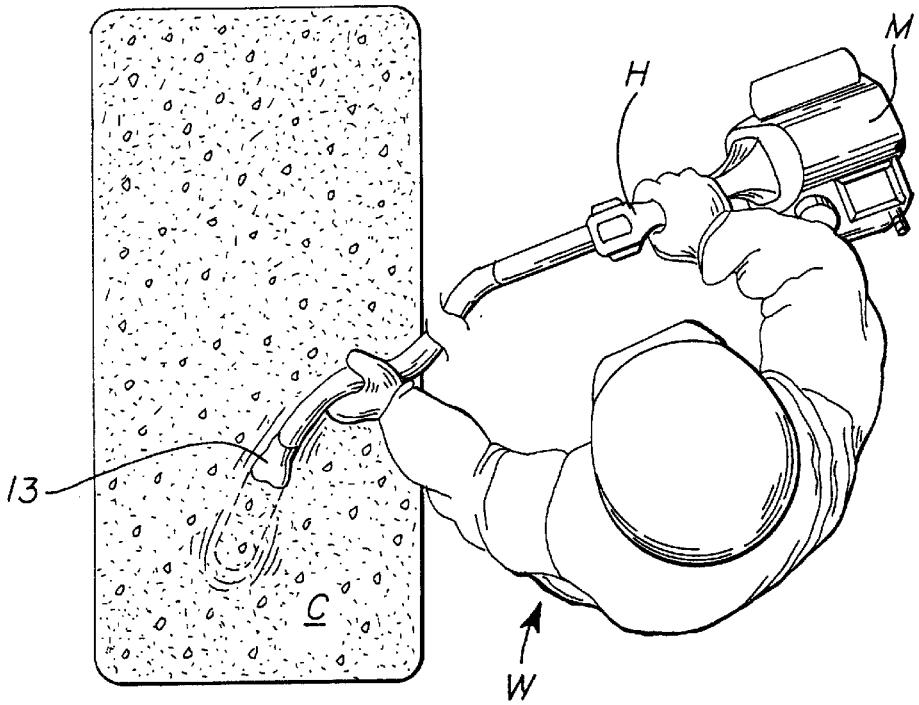

CONCRETE VIBRATOR WITH OFFSET ROTOR

TECHNICAL FIELD

The present invention relates generally to building of structures of concrete, and more particularly, to an improved lightweight, portable concrete vibrator for evenly distributing the aggregate and filling voids in wet concrete, such as during the pouring of columns, walls or like structures in a form.

BACKGROUND OF THE INVENTION

It is well known that the integrity of concrete structures is improved by insuring that the wet concrete poured into the form is substantially homogeneous; that is, with the aggregate spread and evenly distributed and all voids or air pockets being eliminated. To do this, it is common practice to insert a vibrating head into the wet concrete. As it is moved up and down and around the grid of reinforcing bars any pockets of aggregate are broken up and any voids or air bubbles are released and thus eliminated. A typical concrete vibrator includes an electric or gasoline motor connected through a flexible drive cable within a sheath to the vibrator head. The key to success in assuring the proper spreading of the aggregate and eliminating of the voids in the wet concrete is to provide an intense, reasonably high frequency and amplitude vibration of the head.

In the past, the typical approach is to provide an eccentric rotor mounted in the hollow casing to form the head. The rotor is usually formed by a simple machining process where one-half of a solid metal bar is removed. The curved segment formed by this machining process provides an imbalance so that upon rotation around the pintle shafts at the ends, the desired vibration is induced. Typically, the attempt to provide a more intense vibration, and thus provide for better aggregate spreading and void elimination, has been concentrated on providing different forms of motors to drive the rotor. The main objective of using different driving means is for the most part to simply increase the drive speed, and thus the vibration frequency.

A typical recent attempt is shown in the Lyle U.S. Pat. No. 4,057,222. The rotor is the standard one-half metal bar, as shown in FIG. 6, and the driving means is performed by a high speed hydraulic motor. In order to accomplish this increased speed, the vibrator of the '222 patent has thus evolved into a complicated and relatively expensive device to manufacture and to maintain operation.

In the past, it has been found that simply removal of one-half of the rotor leaves much to be desired in terms of the tendency of the rotor to flex laterally as it rotates at the increased speed necessary. One approach to try to overcome this problem is illustrated in the Oswald U.S. Pat. No. 5,108,189. As illustrated, an opposite side fin is left on the rotor during machining in an attempt to stiffen it (see FIGS. 1, 5 and 6). While this approach has some advantages, providing the fin and the curved segment that covers a full 180° arc, as illustrated, means that a substantial portion of the overall mass, including the fin, does not provide any appreciable benefit to the vibrating action. As a point of reference, the centroid of the mass of the curved segment with the stabilizing fin, is positioned appreciably closer to the center of rotation, than in a mass without the fin, as proposed in the prior art '222 patent. Thus, while the design of the '189 patent may maintain increased rotor stability and strength to resist lateral flexing in the casing, the intensity of the vibration at a given rotating speed is significantly reduced.

Other attempts to improve the vibrating action have lead to complicating the structure of the rotor, even more than in the references mentioned above. Typical of these efforts is shown in the Lyle U.S. Pat. No. 4,428,678. As illustrated in this patent, the rotor itself it made up of numerous loose parts which inevitably provides for increased initial cost, as well as greater maintenance requirements.

More recently, some inventors have realized the shortcomings of complicating the structure of the rotor. This latest approach is simply to increase the size of the driving motor and use a speed enhancer to drive the rotor faster. While this does increase the vibration frequency, and thus to some degree the intensity, the cost of the unit is increased greatly, and of course the added cost and maintenance requirements is a significant negative factor. Typically, the driving speed for this type of concrete vibrator is in the range of 10,000–12,000 rpm. The engine required is typically a four cycle design, which adds additional cost to the unit. This more powerful engine is required in order to maintain sufficient torque to drive through the speed enhancer to reach the required high speed of the rotor. Furthermore, as illustrated in a typical approach of this type of arrangement, Breeding U.S. Pat. No. 5,829,874, the engine and speed enhancer unit becomes so heavy and bulky, that it must be adapted to being carried on a backpack for the worker. The lack of maneuverability and the fatigue factor for the worker using this type of concrete vibrator is unsatisfactory to most.

Therefore, it should be appreciated from reviewing the foregoing description of the known prior art, a need is identified for an improved concrete vibrator, particularly with respect to improving the efficiency of the vibration to provide better aggregate spreading and filling of the voids and air pockets, while at the same time providing such a vibrator that is lightweight and portable. Increasing the intensity of vibration at a more reasonable, reduced speed of rotation of the eccentric rotor can also be seen to be very desirable. In addition, the need exists for simplifying the unit to hold down the initial cost and to minimize maintenance requirements over the life of the unit. Overall, the concrete vibrator of the present invention should significantly enhance the ease and efficiency of use by the worker, to not only provide an increase in productivity, but to minimize fatigue.

SUMMARY OF THE INVENTION

With the above needs in mind, it is a primary object of the present invention to provide an improved concrete vibrator that is highly effective in spreading and distributing the aggregate in wet concrete in a form, and at the same time filling and eliminating voids and air pockets, to thereby enhance the integrity of the concrete structure and overcome the above described limitations and disadvantages of the prior art.

It is another object of the present invention to provide a concrete vibrator that is lightweight and portable, is easy to maneuver, and at the same time is capable of inducing a more intense vibration in the wet concrete at a relatively low driving speed.

It is still another object of the present invention to provide a concrete vibrator that is not only low in cost, but easy and inexpensive to maintain.

It is another object of the present invention to provide a concrete vibrator that employs a vibrator head characterized by maximum offset of the centroid of the rotor mass, and the elimination of any mass that does not contribute actively to the desired enhanced vibratory action.

It is still another and related object of the present invention to significantly increase the amplitude of vibration to provide better aggregate distribution and void elimination, and to do so based on a simple one piece eccentric rotor without multiple parts, and at the least expense for initial manufacture.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, there is provided an improved concrete vibrator having a simplified vibrator head that includes a hollow casing and eccentric rotor mounted therein, a drive shaft for imparting rotary motion to the rotor and a relatively low power motor for driving the shaft at reduced rpm's to cause vibration of the head. In accordance with one important aspect of the invention, the rotor includes a curved segment along one of its sides that extends in an arc of less than 180°. By eliminating a portion of the mass below the center line of the rotor, its centroid is positioned in a highly effective relationship with respect to the rotary axis. This positioning or offset of the centroid provides maximum useable vibration to properly distribute the aggregate and to fill or eliminate voids in the wet concrete. At the same time, the rotor strength is maintained to resist lateral flexing within the casing to minimize wear and to keep maintenance requirements down.

The rotor is preferably machined from a metal bar, more specifically the rotor is formed of cold rolled steel that provides the desired mass along with reasonably good machining properties. However, in accordance with broader aspects of the present invention, it is understood that other techniques can be used to form the rotor, such as by casting metal or other material to form it. The rotor also includes a pintle shaft at each end that is suitably mounted in dual roller bearings within the casing. With this arrangement and the improved positioning of the rotor centroid, the vibrator head provides more intense vibration, principally in terms of increased vibratory amplitude. Enhanced distribution of the aggregate and the filling of voids or air pockets can be obtained at a slower rotation speed than previously possible. In turn, a smaller motor with less horsepower can be utilized for driving the drive shaft of the rotor to minimize the initial expense of manufacture, cost of operation and the maintenance requirements.

The rotor strength is preferably obtained in the preferred embodiment of the invention by utilizing a stiffening segment extending along the side of the rotor opposite the weighted curved segment. The stiffening segment is specifically structured so as to resist lateral flexing of the rotor in the casing as it is rotated to generate the necessary vibration. It has been found that the best design is a substantially V-shaped segment, inverted along the side of the rotor, with the apex of the V being positioned adjacent the center axis of rotation. The distal ends of the V-shaped segment are connected adjacent the ends of the curved segment to complete the present preferred form of the rotor.

The curved segment in the preferred embodiment also forms an arc of approximately 120°, that is approximately 60° less than the closest prior art that utilizes a substantially 180° segment. In this form, the V-shaped segment that provides stiffening of the rotor forms the same included angle at its apex adjacent the rotation center. Essentially the entire mass of the rotor is useful to generate the vibratory action, as desired.

As a result of extensive testing, a ratio of the offset of the centroid of the curved segment from the rotation axis to the diameter of the path of movement traced by the outer face of the curved segment is determined to be in the range of 1:3.5–1:3.75. More specifically, the best results so far have been obtained by forming the curved segment and the inverted V-shaped segment connected thereto so that the ratio is 3.63. On a rotor of 1.3125 inches diameter for the path traced by the outer face of the curved segment during rotation, the offset is 0.3618. The casing and rotor are elongated with the dual bearings being positioned to support the pintle shafts adjacent the ends.

According to another feature of the present invention, a separate bearing sleeve is positioned in the casing adjacent the second (non-driven) end of the curved segment in order to accommodate any incidental lateral deflection of the rotor during operation.

In order to provide for exceptional ease of use and maneuverability, by the operator, as well as keeping the concrete vibrator low in cost and maintenance free, the motor is a lightweight gasoline engine. A tubular support assembly is provided on the frame of the motor and surrounds the output shaft. Advantageously, the tubular support assembly serves as a convenient handle for the motor and includes a throttle lever and kill switch for the convenience of operation. A flexible sheath and drive cable is connected between the output shaft of the motor and the drive shaft of the rotor. This support and control arrangement adds to the easy maneuverability of the vibrator. The operator uses his free hand for positioning of the vibrator head in the wet concrete. The overall productivity of the worker is enhanced and fatigue is minimized.

As a benefit primarily of forming the rotor with a centroid favorably positioned an extended distance from the center of rotation, the rotor can be driven at a substantially reduced speed from the normal 10,000 to 15,000 rpm speed of the prior art units. More particularly, highly efficient movement of the aggregate for even distribution and for filling of the voids in the wet concrete can be obtained utilizing the rotor speed in the range of just 5,000 to 7,000 rpm.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings:

FIG. 1 is an overall perspective view of the concrete vibrator of the present invention including the motor, tubular support assembly forming the handle, the flexible sheath and drive cable and the vibrator head connecting to its distal end;

FIG. 4 is a representative view of the manner in which the concrete vibrator of the present invention can be used by an operator for evenly distributing aggregate and eliminating voids in wet concrete in a form, such as for a column in a building or the like.

Reference will now be made in detail to the present preferred embodiment of the invention, an example of which is illustrated in the accompanying drawings.

DETAILED DESCRIPTION OF THE INVENTION

Reference is now made to FIG. 1 illustrating a preferred embodiment of the improved concrete vibrator of the present invention for distributing the aggregate and filling voids in wet concrete in a column, wall or other structure. A lightweight motor M, such as a 2-cycle gasoline engine, is provided with a tubular support assembly 11 forming a handle H and surrounding the output shaft (not shown in this figure). A flexible sheath and drive cable 12 is connected to the output shaft and the proximal end extends up through the support assembly 11. The distal end of the sheath/drive cable 12 is connected to a vibrator head 13. As illustrated in FIG. 4, the vibrator head 13 is inserted into a column or other structure forming the body of wet concrete C by an operator W in order to achieve the desired distribution of the aggregate and filling of the voids to enhance the strength of the finished structure.

Figure 2A:
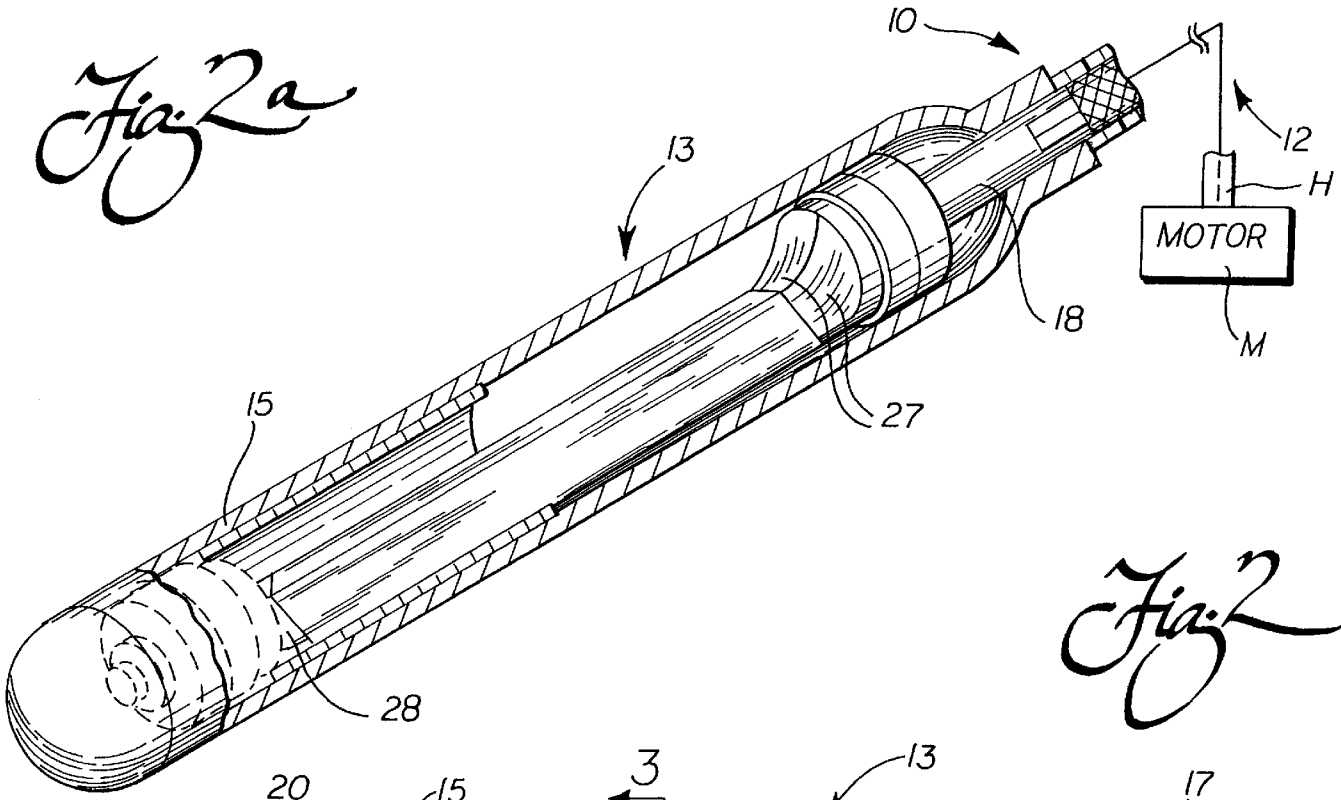
FIG. 2*a* is a perspective view of the vibrator head and illustrating in additional detail the preferred form of this component of the vibrator.
Figure 2:
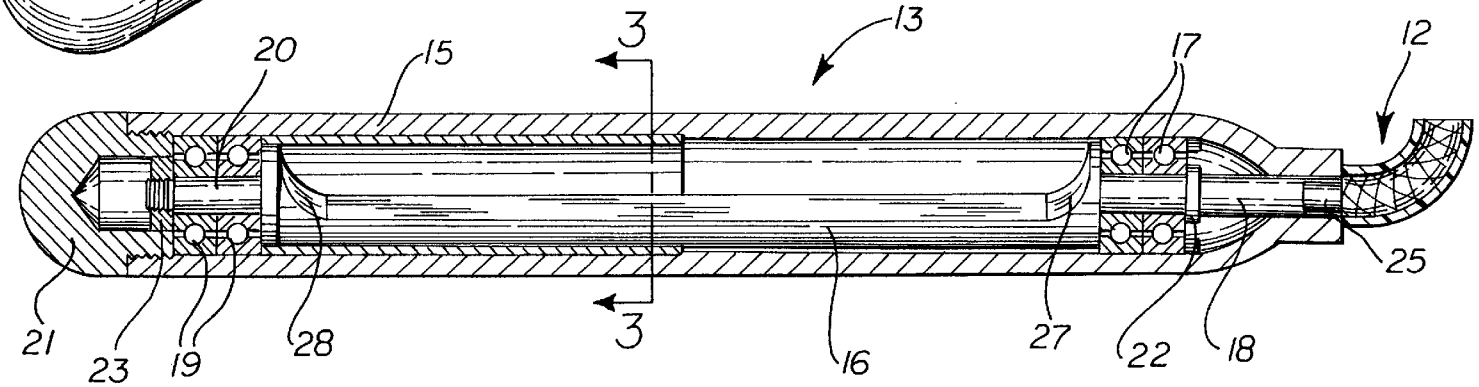
FIG. 2 is a cross sectional view of the vibrator head illustrating the preferred form of the eccentric rotor of the invention.

As illustrated in FIG. 2, the vibrator head 13 includes a hollow casing 15 and an eccentric rotor 16 mounted by dual bearings at the two ends. More specifically, dual bearings 17 support the pintle/drive shaft 18 at the proximal end and dual bearings 19 support the pintle shaft 20 at the distal end. This assembly of components is completed by a cap 21 at the distal end. A collar 22 on the pintle/drive shaft 18 and a nut 23 on the end of the pintle shaft 20 serves to complete the rotor assembly.

The pintle/drive shaft 18 is connected by a coupling 25 to the flexible sheath/drive cable 12 as shown in both FIGS. 2 and 2*a*. The flexible cable is a standard drive cable and allows the operator W to maneuver the head 13 into position for vibrating the body of wet concrete C throughout the entire structure, as illustrated in FIG. 4. A key advantage of the present invention is that the gasoline engine selected for the motor M is lightweight and relatively low power, and coupled to the vibrator head 13, it can provide the more intense vibration that is needed to properly distribute the aggregate and to fill the voids or air pockets in the body of wet concrete C. Specifically, I have found that a selection of a one and one-half horse power, two cycle engine, such as the 30.5 cc Fuji Robbins, or the equivalent Honda 34 cc two cycle engine, works well. These relatively low power engines operate in a direct drive speed range of 5,000–7,000 rpm. Because of the enhanced vibratory action of the vibrator head 13, as will be seen more in detail below, the use of these engines is now possible. Indeed, as illustrated in FIG. 4, the operator W can comfortably hold the motor M in one hand by grasping the handle H formed by the tubular support assembly 11, and then easily maneuver the vibrator head 13 with the other hand. A throttle 26 and kill switch 27 are conveniently positioned on the handle H for easy operation.

In accordance with an important aspect of the present invention, the vibrator head 13 incorporates the specially designed eccentric rotor 16 with the features that provide for improved vibration, and thus allow for use of the motor M rotating at the desirable lower speed, as described above. Specifically in this regard, the rotor 16 is machined from cold rolled steel and takes the overall form as best shown in FIGS. 2 and 2*a*. Adjacent the ends there are formed transition faces 27, 28 which connect the operative reduced section of the rotor to the mounting pintle shafts 18, 20 (see FIGS. 2, 2*a*). Upon being driven by the flexible cable through the coupling 25, the pintle/drive shaft 18 imparts rotation to the rotor 16 through full 360° cycles repeated at 5,000–7,000 times per minute. As will be realized, this driving speed is more desirable, not only because it allows a smaller motor M to be used, but also because it is less costly to operate and inherently increases the life expectancy of the vibrator head 13 and its component parts.

Figure 3:
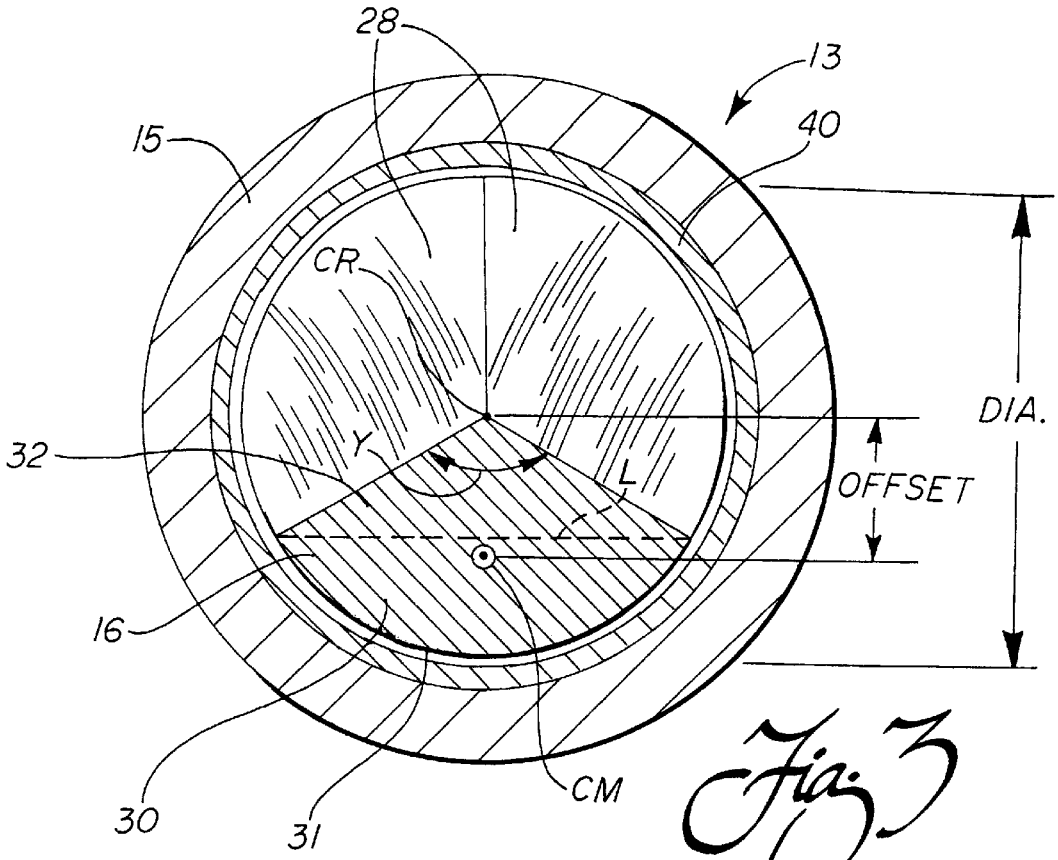
FIG. 3 is a enlarged cross sectional view taken along line 3—3 of FIG. 2 and illustrating the rotor with the curved segment extending in an arc along one side of the dashed line with the inverted, V-shaped stiffening segment along the other side.

In order to explain in more detail key aspects of the rotor 16, reference is made to FIGS. 3 and 3*a* wherein is illustrated in cross section the reduced section of the rotor 16 that comprises a curved segment or portion 30 disposed below dashed line L having an outer face 31 along one side, and an stiffening segment 32 with an inverted V-shaped outer surface along the other side of the dashed line L. The combined curved segment 30 and the stiffening segment 32 provides for the improved vibrating characteristic of the rotor 16 over previous designs. The inner extent, or the apex of the stiffening segment 32 is preferably positioned adjacent the center of rotation CR. A significant feature is that the curved segment 30 extends along one side in an arc of less than 180°. This places the rotor centroid, or center of mass CM between the center axis of rotation CR and the outer face 31 of the curved segment 30. As will be seen more in detail, this positioning provides for enhanced vibration, primarily through increased amplitude, and thus better aggregate distribution and filling of the voids in the wet concrete. The distal ends of the V-shaped stiffening segment connect adjacent the ends of the curved segment 30. Preferably, a curved segment forms an arc of approximately 120° measured around the outer face 31, as best shown in FIG. 3. This means that the stiffening segment 32 has an included angle Y at its apex that is also 120°.

It has been found through extensive experimentation, that starting with a nominal 1 5/16 bar to form the rotor 16, the centroid CM is positioned offset from the center of rotation CR at a distance of 0.3618 inch. In other words, starting with a metal bar for the rotor 16 that has a 1 5/16 inches diameter dimension (1.3125 inches), the centroid CM will be positioned at this location. This is a significant outward movement of the centroid CM from the position that would be provided in a prior art rotor of the same dimensions with a 180° curved segment and thus improves the vibratory effect. As an example, a simple rotor having an arc of 180° has the centroid positioned at 0.2786 inch when considering the same size basic rotor dimension. In contrast, the prior art design where a stiffening fin is provided opposite the curved segment, the centroid CM is only 0.2131 inch from the center of rotation CR. Within the broader aspects of this specific feature of the present invention, the ratio of the centroid CM offset from the rotation axis CR to the diameter of the path of movement traced by the outer face 31 of the curved segment 16 is in the range of 1:3.5–1:3.75.

Figure 3A:
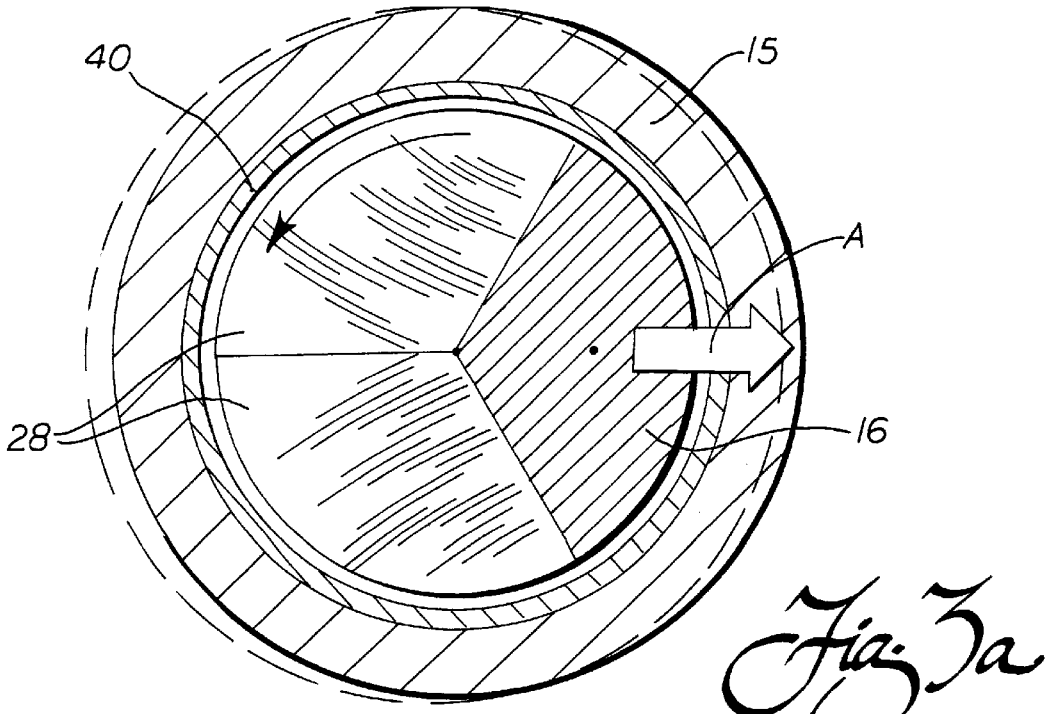
FIG. 3*a* is a cross section of the eccentric rotor that is the same as illustrated in FIG. 3, except that the rotor is turned through 90° and with a showing of the vibratory action.

By viewing FIG. 3*a*, the manner in which the rotor 16 causes vibratory action can be better understood. For example, as the rotor rotates in the counterclockwise direction as indicated, the centrifical force of the rotor 16 causes a substantial side force, as illustrated by the 90° action arrow A. The manner in which the casing 15 is shifted from the original dashed line position shown in this figure illustrates the manner in which the desired vibration occurs. Of course, as the rotor 16 continues its rotation through the remainder 270° of movement from the FIG. 3*a* position and back to the FIG. 3 position, the enhanced vibrating action occurs in all directions to provide the highly efficient vibratory action desired for acting on the wet concrete C (see FIG. 4).

In order to ensure that the casing 15 is protected from incidental lateral flexing by the rotor 16, a bronze bearing sleeve 40 can be used adjacent the distal end of the vibrator head 13, as best illustrated in FIGS. 2–3*a*. For example, in an incident of overspeed operation, the outer face 31 of the curved segment 30 can engage the inner bearing surface of the sleeve 40 with essentially no reduction in speed of rotation of the rotor 16 or damage to either the rotor or the casing 15.

In summary, the substantial results and advantages of the improved concrete vibrator 10 of the present invention can now be realized. The vibrator head 13 operates in a manner to provide maximum vibration to efficiently distribute the aggregate and fill any voids in the wet concrete C in a manner not heretofore obtainable. Advantageously, the motor M used for driving the rotor 16 is a lightweight, gasoline engine that rotates at a relatively low speed of 5,000–7,000 rpms. Because of the lightweight design, the operator W can comfortably hold the entire vibrator 10 with one hand and easily maneuver the vibrator head 13 to more efficiently settle the wet concrete C with the other (see FIG. 4). No backpack, or other cumbersome support is needed.

A key feature of providing the enhanced vibration at the lower speed, and thus allowing the use of a smaller motor M, is in having a rotor 16 with a curved segment 30 extending in an arc of less than 180°, and more particularly in an arc of approximately 120°. The rotor centroid CM is advantageously positioned spaced a maximum distance from the center of rotation CR to increase the vibration action, especially the amplitude (see FIG. 3*a*). Lateral flexing of the rotor 16 is prevented by the improved stability and strength provided by the inverted V-shaped segment 32 on the other side of the rotor 16.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A lightweight, portable concrete vibrator comprising:

a vibrator head including a hollow casing and eccentric rotor mounted at at least one end therein for rotation;

a drive shaft for imparting rotary motion to the rotor at said one end fixed along a center axis of rotation;

a motor for driving said shaft to cause vibration of the head upon rotation of the rotor; and said rotor having an integral curved segment between said at least one end and an opposite end disposed only along one side of the center axis of rotation, said curved segment extending in an arc of less than 180°, the rotor centroid being offset except for said at least one end from the center axis of rotation and positioned between the center axis of rotation and the outer face of said curved segment, said rotor having an integral stiffening segment extending from substantially the center axis of rotation to said curved segment, whereby the offset of said rotor and said centroid of said rotor beyond said at least one end provides maximum vibration to distribute the aggregate and fill voids in wet concrete, while maintaining sufficient rotor strength to resist lateral flexing of the rotor in the casing.

2. The concrete vibrator of claim 1, wherein said stiffening segment has a substantially V-shaped outer surface and inverted along said other side, the apex of the V being positioned adjacent the center axis of rotation and the distal ends of the V-shaped segment being connected adjacent the ends of the curved segment.

3. The concrete vibrator of claim 1, wherein the ratio of the centroid offset from the rotation axis to the diameter of the path of movement traced by the outer face of the curved segment is in the range of 1:3.5–1:3.75.

4. The concrete vibrator of claim 3, wherein said centroid offset is 0.3618 inch on a 1.3125 inches diameter path of rotation of said outer face.

5. The concrete vibrator of claim 1, wherein the motor is a lightweight gasoline engine with an output shaft, a tubular support assembly for the motor serving as a handle, a flexible sheath and drive cable connected between said output shaft of the motor and the drive shaft of said rotor, whereby said concrete vibrator can be manually handled and manipulated by one hand on the handle and the other hand on the sheath adjacent the head to provide easy positioning of the head in the wet concrete.

6. The concrete vibrator of claim 5, wherein the engine operates in the range of 5,000 to 7,000 rpm.

7. A lightweight, portable concrete vibrator comprising:

a vibrator head including a hollow casing and eccentric rotor mounted at its ends therein for rotation;

a drive shaft for imparting rotary motion to the rotor along a center axis of rotation;

a motor for driving said shaft to cause vibration of the head upon rotation of the rotor; and said rotor having an integral curved segment between said ends disposed only along one side of the center axis of rotation, said curved segment extending in an arc of less than 180°, the rotor centroid being offset except for said ends from the center axis of rotation and positioned between the center axis of rotation and the outer face of said curved segment, an integral stiffening segment extends along the other side of said rotor to further resist lateral flexing of said rotor in said casing, said stiffening segment having an outer surface that is substantially V-shaped and inverted along said other side, the apex of the V being positioned adjacent the center axis of rotation and the distal ends of the V-shaped segment being integrally connected adjacent the ends of the curved segment, whereby the offset of said rotor and said centroid of said rotor except for said ends provides maximum vibration to distribute the aggregate and fill voids in wet concrete, while maintaining sufficient rotor strength to resist lateral flexing of the rotor in the casing.

8. The concrete vibrator of claim 7, wherein said curved segment forms an arc of approximately 120° and said V-shaped segment forms the same included angle at its apex.

9. A lightweight, portable concrete vibrator comprising:

a vibrator head including a hollow casing and eccentric rotor mounted at its ends therein for rotation;

a drive shaft for imparting rotary motion to the rotor along a center axis of rotation;

a motor for driving said shaft to cause vibration of the head upon rotation of the rotor; and said rotor having an integral curved segment between said ends disposed only along one side of the center axis of rotation, said curved segment extending in an arc of less than 180°, the rotor centroid being offset except for said ends from the center axis of rotation and positioned between the center axis of rotation and the outer face of said curved segment, said casing and rotor being elongated and a first bearing is provided adjacent the first end of the rotor connected to said drive shaft and a second bearing adjacent the second end of the rotor spaced from said first end for support of said rotor in the casing;

a bearing sleeve in said casing adjacent said second end for engagement by said curved segment upon any incidental lateral deflection of said rotor, whereby the offset of said centroid of said rotor except for said ends provides maximum vibration to distribute the aggregate and fill voids in wet concrete, while maintaining sufficient rotor strength to resist lateral flexing of the rotor in the casing.

10. The concrete vibrator of claim 9, wherein the rotor is cold rolled steel and said bearing sleeve is bronze.

11. A vibrator head comprising an eccentric rotor mounted for rotation;

a casing and a shaft in said casing for mounting said rotor at at least one end;

said rotor having an integral curved segment between said at least one end and an opposite end disposed only along one side of the center axis of rotation, said curved segment extending in an arc of less than 180°, the rotor centroid being offset except for said at least one end from the center axis of rotation and positioned between the center axis of rotation and the outer face of said curved segment, an integral stiffening segment extends along the other side of said rotor to further resist lateral flexing of said rotor; and said stiffening segment having an outer surface that is substantially V-shaped and inverted along said other side, the apex of the V being positioned adjacent the center axis of rotation and the distal ends of the V-shaped segment being integrally connected adjacent the ends of the curved segment, whereby the offset of said rotor and said centroid of said rotor except for said at least one end provides maximum vibration to distribute the aggregate and fill voids in wet concrete, while maintaining sufficient rotor strength to resist lateral flexing of the rotor in the case.

12. The vibrator head of claim 11, wherein said curved segment forms an arc of approximately 120° and said V-shaped segment forms the same included angle at its apex.

13. The vibrator head of claim 11, wherein the ratio of the centroid offset from the rotation axis to the diameter of the path of movement traced by the outer face of the curved segment is in the range of 1:3.5–1:3.75.

14. The vibrator head of claim 13, wherein said centroid offset is 0.3618 inch on a 1.3125 inches diameter path of rotation of said outer face.

* * * * *